United States Patent [19]

Klett et al.

[11] 3,979,896

[45] Sept. 14, 1976

[54] IMPREGNATED AND ENCAPSULATED WIRE ROPE AND CABLE

[75] Inventors: George J. Klett, Alexandria, Va.; William M. Capece, Philadelphia; Martin J. Devine, Havertown, both of Pa.

[73] Assignee: The United States of America as represented by the Secretary of the Navy, Washington, D.C.

[22] Filed: Feb. 24, 1975

[21] Appl. No.: 552,085

[52] U.S. Cl. ..... 57/149; 57/162

[51] Int. Cl.[2] ..... D07B 1/16

[58] Field of Search ..... 57/139, 149, 153, 156, 57/162, 160, 164; 427/117–120

[56] References Cited

UNITED STATES PATENTS

| | | | |
|---|---|---|---|
| 3,646,748 | 3/1972 | Lang | 57/149 |
| 3,681,911 | 8/1972 | Humphries | 57/149 |
| 3,705,489 | 12/1972 | Smollinger | 57/153 X |
| 3,764,452 | 10/1973 | Marzochi | 57/149 X |
| 3,778,994 | 12/1973 | Humphries | 57/162 X |
| 3,800,522 | 4/1974 | Hughes et al. | 57/149 |
| 3,824,777 | 7/1974 | Riggs | 57/149 |
| 3,899,384 | 8/1975 | Kelley | 57/149 X |

*Primary Examiner*—Donald E. Watkins
*Attorney, Agent, or Firm*—R. S. Sciascia; Henry Hansen

[57] ABSTRACT

A stranded cable having corrosion preventive lubrication permanently entrapped within the interstices between the individual strands comprising the cable and encapsulated with an adherent plastic bonded film sheathing in a manner which substantially prevents air pocket formation between the lubrication impregnated cable and the plastic sheath.

13 Claims, 2 Drawing Figures

IMPREGNATED AND ENCAPSULATED WIRE ROPE AND CABLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to cables and in particular to helically twisted stranded cables which are impregnated with corrosion preventive lubricant and thereafter encapsulated within a plastic sheathing.

Naval aircraft control cables, such as rudder and throttle control cables, exhibit severe deterioration caused by corrosion, wear and fretting. Corrosion comes about by exposure to humid air and saltsprays; wear progresses as the cables move over pulleys; and fretting occurs as the working control cables flex thereby inducing the individual strands of the cable to rub gainst each other. Cable deterioration not only reduces flight safety and aircraft flight performance characteristics but also requires extensive replacement of the cables after an undesirably short service life of approximately six months or less. To combat cable deterioration, a currently used cable protection method requires that control cables be subjected to a hot dipping process using a preservative compound. This method has several drawbacks, however, chief among them being that it does not maintain adequate lubrication between the individual strands of the control cables. Furthermore, the currently used cable protection method does not provide for internal and/or external abrasion resistance or adequate corrosion protection.

SUMMARY OF THE INVENTION

Accordingly it is an object of this invention to provide a method of cable protection which reduces fretting, increases corrosion resistance and reduces wear. It is a further object of this invention to provide a stranded cable having lubrication permanently entrapped within the interstices of the strands comprising the cable. It is a further object of this invention to provide a permanently lubricated, stranded cable having a closely adhering plastic integument thereon and having substantially no air pockets between the stranded cable and the plastic integument. These and other objects are achieved as follows.

A stranded cable is degreased and thereafter totally immersed within a mixture of hexane and lubricant. The immersed cable is placed in a pressure chamber for a predetermined time to thereby drive the lubricant into all the interstices between the individual strands. After the hexane has evaporated, the cable surface is wiped clean of excess lubricant and thereafter provided with a corrosion inhibiting primer. After the primer has dried, a thermoplastic polymer is applied to the primed cable and thereafter heat cured to form a closely adhering bonded film integument or sheathing which encases the lubrication impregnated cable.

Other objects, advantages and novel features of the invention will become apparent from the following detailed description of the invention when considered in conjunction with the accompanying drawings.

DESCRIPTION OF THE PREFERRED EMBODIMENT

Figure 1:
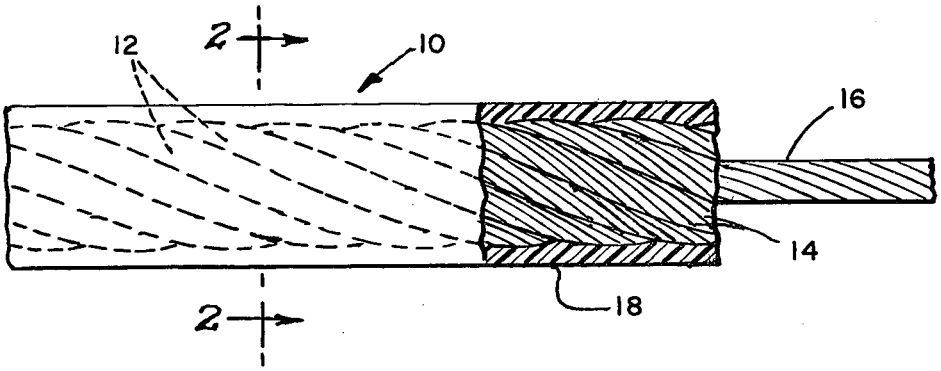
FIG. 1 is a partially cut away view of a cable comprising a plurality of helically twisted strands encased in an adherent plastic bonded film sheathing.

Referring to FIG. 1 there is shown a metallic cable 10 having six helically twisted outer strands 12 composed of individual wires 14. The strands 12 are helically twisted about a wire core 16. The cable 10 includes an adherent plastic bonded film sheathing 18 which completely encapsulates the strands 12.

Figure 2:
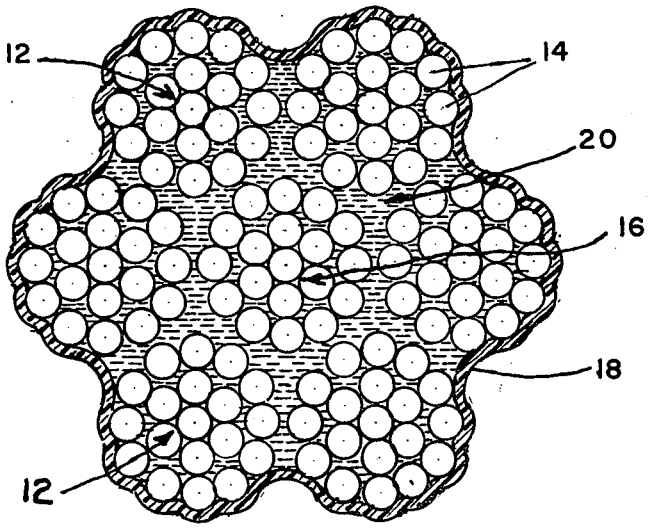
FIG. 2 is a cross section taken at line 2—2 of FIG. 1 showing the interstices of the cable substantially filled with entrapped lubrication and corrosion preventive.

FIG. 2 is an enlarged and exaggerated view of a typical cross section of the cable shown in FIG. 1. Corrosion preventive lubricant 20 occupies the interstices between the wires 14 comprising the wire core 16 and the strands 12 and also occupies the interstices between the individual strands 12 and the wire core 16. The adherent plastic integument or sheathing 18 surrounds the entire periphery of the cable 10 and serves, among other things, to entrap the corrosion preventive lubricant 20.

The method of making the article shown in FIGS. 1 and 2 is set forth below.

A predetermined length of cable 10 comprising a plurality of helically twisted metalic strands 12 is first degreased and cleansed by submersion in hot trichloroethylene at 180°F. to 250°F. for approximately one hour. Alternatively the cable 10 may be cleansed in a vapor degreasing tank for approximately fifteen to sixty minutes depending on cable size. Cleansing removes foreign particles and contaminants which may induce corrosion.

The cleansed and degreased cable is then immersed in a slurry contained in a conventional pressure chamber. The slurry is a mixture of a conventional solvent and a thickened, high temperature, synthetic hydrocarbon grease. The solvent is preferably hexane, heptane or equivalent and comprises 30% to 50% of the slurry. The chamber is sealed and the pressure in the chamber is raised to approximately 70 to 100 psi air or nitrogen pressure depending on chamber structure and kept at that level for approximately one and one half hours. (Impregnation time may be reduced by increasing the applied pressure.) Pressurization of the immersed cable 10 drives the grease into the interstices between the individual strands 12 comprising the cable and simultaneously drives out the entrapped air, thereby impregnating the grease between the cable strands 12 and wires 14.

After the cable has been impregnated it is removed from the pressure chamber and allowed to air dry for approximately one hour or dry in an oven purged with nitrogen for approximately 15 minutes at approximately 400°F. Air drying allows the solvent to evaporate leaving behind the grease. Any excess grease on the exposed exterior surface of the cable is wiped off with a lint free cloth moistened with hexane or other solvent so as to make the cable surface appear clean to the eye. The entire outer surface of the cable may optionally be provided with a corrosion preventing primer by spraying or other suitable means and allowed to dry for approximately one hour.

Using a conventional electrostatic deposition method, nylon powder is applied to the exposed outer surface of the impregnated cable. The nylon coated cable is cured in an oven at 400°F. to 500°F. for approximately three minutes to thereby form a closely adhering sheathing two to seven mils thick. (The grease does not melt because it is a high temperature grease.) It should be noted here that the nylon powder is applied to a metallic surface which is not clean in the conventional sense. Even so, the nylon forms a continuous coating which closely adheres to the exposed exterior surfaces of the impregnated cable. This is a surprising and wholly unexpected result completely contrary to prior art teachings which generally teach that the metallic substrate must be meticulously cleansed before applying nylon powder.

The exact interface between the impregnated cable strands 12, primed or unprimed, and the nylon encapsulation 18 is not clearly definable. The nylon is not bonded to the metal surface in the conventional sense; rather, the nylon closely adheres to the cable surface by insinuating itself into the grooves formed by the exposed exterior surfaces of the individual helically wound strands 12 of the cable. Since the nylon powder is directly deposited on the exposed exterior surface of the impregnated cable 10 and thereafter heat cured, substantially no air pockets remain between the cured nylon encapsulation and the cable surface. Elimination of air pockets is most desirable since residual air pockets are sources of corrosion and because air pockets act as reservoirs for lubricants pumped away from internal areas of the cable 10 by the relative motion of the individual strands 12 as the cable 10 is worked. Elimination of air pockets or void spaces permits retention of the corrosion preventive lubricant in the critical interstitial areas of the cable 10.

The nylon powder or other suitable thermoplastic polymer may be applied to the cable by use of a conventional fluid bed technique rather than by use of the electrostatic deposition technique. As in the electrostatic deposition technique, air pockets are substantially eliminated since the nylon powder is again directly deposited on the exposed exterior surfaces of the impregnated cable 10.

By grease is meant a grease or lubrication having a melting point in excess of 400°F. and exhibiting no corrosion characteristics in the "ASTM" rust preventive properties test, ASTM D1743. A grease suitable for use in this invention is a thickened synthetic hydrocarbon oil base grease such as that set forth in Military Specification MIL-G-81322. Use of high temperature grease prevents its liquification during the curing of the nylon powder.

By primer is meant a corrosion preventing primer suitable for brush, dip or spray application and capable of curing at approximately 77°F. within 1 hour. A primer suitable for use in this invention is Rilsan No. 104 primer, manufactured by Rilsan Corp., Glen Rock, N.J. Another suitable primer is that set forth in Military Specification MIL-P-23377C. Application of the primer is optional but desirable in some applications. Should the nylon encapsulation 18 rupture during use of the cable 10, the primer would react with the metallic strands 12 to protect the cable 10 from deleterious environmental effects. The primer reacts with the metallic strands 12 to form a protective layer by sacrificial reaction with the corrodent.

By nylon powder is meant a conventional electrostatically depositable thermoplastic polymer. A nylon powder suitable for use in the present invention is Rilsan nylon 11 natural ES (RDP-15), manufactured by Rilsan Corp., Glen Rock N.J. The natural or unpigmented powder cures to a transparent state which permits observation of the underlying cable while in service. Other thermoplastic polymers, vinyl, or epoxy may also be used for the plastic sheathing 18.

The method of impregnation and encapsulation is not limited to metallic cables but may also be applied to cables comprising synthetic fibers. For purposes of maintaining naval aircraft, pressure impregnation of the grease is desirable since all aircraft maintenance stations have pressure chambers. However, in lieu of pressure impregnation, the grease may be impregnated by conventional vacuum techniques. Vacuum impregnation of cables comprising synthetic fibers is preferred since pressure tends to compress the synthetic strands to a greater extent than metallic strands to thereby prevent complete impregnation of the grease within the cable interstices.

The foregoing method of impregnating and encapsulating a stranded cable is preferably applied to cables which have not yet been placed in service. However, cables which have been used in service may also be protected by the foregoing method if steps are taken to ensure removal of residual preservative, moisture, saltwater, contaminants and corrosion products prior to impregnating and encapsulating the cable.

From the foregoing it is clear that a superior cable and a method for making it have been disclosed. Permanently entrapped lubrication minimizes fretting as the cable is worked and the individual strands flex against each other; corrosion is minimized by the joint action of a surface applied primer and a closely fitting plastic sheathing; corrosion is further minimized by ensuring that substantially no air pockets remain between the cable and the plastic sheathing; and wear is minimized by the protective action of the plastic sheathing which acts as a buffer between the cable and pulleys, etc.

Obviously many modifications and variations of the present invention are possible in the light of the above teachings. It is therefore to be understood that within the scope of the appended claims the invention may be practiced otherwise than as specifically described.

We claim:

1. A method of making a stranded cable having an improved working life comprising the steps of: immersing said cable in a slurry comprising a predetermined mixture of lubricant and solvent therefor; and applying predetermined pressure to said immersed cable to thereby urge said slurry between and within the strands of said cable and to concommitantly displace substantially all air between and within the strands of said cable.

2. A method of making an improved stranded cable, having a closely adherent plastic sheathing surrounding said cable which clings to the exposed exterior surfaces of the cable strands to thereby form an interace between the sheathing and the stranded cable which is substantially devoid of air pockets, comprising the steps of:

cleansing said cable for a predetermined time with a cleansing agent;

immersing said cable in a slurry comprising a predetermined mixture of corrosion preventive lubricant and solvent therefor;

applying predetermined pressure to said immersed cable for a predetermined time to thereby force said slurry into substantially all interstices of said cable and to concommitantly displace substantially all air entrapped within said interstices to thereby form an impregnated cable;

removing said cable from said slurry;

drying said impregnated cable for a predetermined time to thereby evaporate said solvent;

removing any excess lubricant from the surface of said impregnated cable;

displacing substantially all air at the exposed exterior surfaces of said impregnated cable by depositing a powdered thermoplastic polymer directly onto said surfaces; and curing said powdered thermoplastic polymer for a predetermined time at a predetermined temperature.

3. A method according to claim 2 further including, after the step of removing excess lubricant, the step of:

providing said impregnated cable with a coating of corrosion preventing primer.

4. A method according to claim 1 further comprising, after the step of applying predetermined pressure, the steps of:

removing said cable from said slurry; and drying said cable for a predetermined time to evaporate thereby said lubricant solvent.

5. A method according to claim 4 further comprising, after the step of drying said cable, the steps of:

removing excess lubricant from the surface of said cable;

displacing substantially all air at the exposed exterior surfaces of said cable by depositing a powdered thermoplastic polymer directly onto said exposed surfaces; and curing said powdered thermoplastic polymer for a predetermined time at a predetermined temperature to thereby form a closely adhering sheathing upon said cable.

6. A method according to claim 5 further comprising, after the step of removing excess lubricant, the step of:

applying a coating of corrosion preventing primer to the surface of said cable.

7. A method according to claim 5 wherein said powdered thermoplastic material is nylon.

8. A cable comprising:

a plurality of strands laid about a wire core, said strands intimately contacting each other and said wire core to thereby form a plurality of interstitial spaces among said strands and between said strands and said wire core;

a quantity of lubricant in substantially all of said plurality of interstitial spaces; and a thermoplastic integument intimately and directly contacting substantially all exposed exterior surfaces of said strands and formed thereon by depositing thermoplastic material on said surfaces and thereafter curing said material.

9. A cable according to claim 8 comprising:

a coating of corrosion preventive primer overlaying the exterior surfaces of said strands, wherein said integument intimately and directly contacts the primer coated exterior surfaces of said strands and is formed thereon.

10. A cable according to claim 8 wherein said thermoplastic material is electrostatically deposited on said surfaces.

11. A cable according to claim 10 wherein said thermoplastic material is nylon.

12. A cable comprising:

a plurality of strands laid about a wire core, said strands intimately contacting each other and said wire core to thereby form a plurality of interstitial spaces among said strands and between said strands and said wire core;

a quantity of lubricant is substantially all of said plurality of interstitial spaces; and a thermoplastic integument intimately and directly contacting substantially all exposed exterior surfaces of said strands to thereby form a substantially fluid free interface between said surfaces and said integument.

13. A cable according to claim 12 further including:

a coating of corrosion preventive primer overlaying the exterior surfaces of said strands, wherein said integument intimately and directly contacts the primer coated exterior surfaces of said strands.

* * * * *